United States Patent [19]

Kusek

[11] Patent Number: 4,944,208

[45] Date of Patent: Jul. 31, 1990

[54] GUITAR WITH ADJUSTABLE TREMOLO

[76] Inventor: Peter A. Kusek, 1705 Westchester, Denton, Tex. 76201

[21] Appl. No.: 341,541

[22] Filed: Apr. 21, 1989

[51] Int. Cl.[5] ..... G10D 3/12

[52] U.S. Cl. ..... 84/313

[58] Field of Search ..... 84/313

[56] References Cited

U.S. PATENT DOCUMENTS

| | | | |
|---|---|---|---|
| 2,949,806 | 8/1960 | Turman | 84/313 X |
| 3,479,917 | 11/1969 | Zitnik | 84/313 X |
| 3,686,993 | 8/1972 | Fender | 84/313 X |
| 4,171,661 | 10/1979 | Rose | 84/313 |
| 4,497,236 | 12/1985 | Rose | 84/298 |
| 4,549,461 | 10/1985 | Rose | 84/313 |
| 4,555,970 | 2/1985 | Rose | 84/313 |
| 4,648,304 | 3/1987 | Hoshino et al. | 84/313 |
| 4,782,732 | 11/1988 | Kato et al. | 84/313 |

*Primary Examiner*—Lawrence R. Franklin
*Attorney, Agent, or Firm*—H. Dennis Kelly

[57] ABSTRACT

Disclosed is a guitar having a tremolo device that selectively modulates the pitches of the strings either individually or collectively. An actuator is moved between a first position and a second position by an activation lever. In the first position, the actuator allows the tremolo keys to operate individually. In the second position, the actuator locks the tremolo keys together, so that the tremolo keys operate collectively to modulate the pitches of the strings.

4 Claims, 4 Drawing Sheets

GUITAR WITH ADJUSTABLE TREMOLO

BACKGROUND OF THE INVENTION

1. Field of the Invention:

This invention relates in general to stringed musical instruments. In particular, the invention relates to guitars having tremolos for modulating the pitches of the strings.

2. Description of the Prior Art:

A tremolo temporarily changes the pitches of the strings on a guitar to a different pitch. The tremolo is used by pressing down or pulling up on a tremolo bar. Moving the tremolo bar raises or lowers the pitch of the strings, as desired. When the tremolo bar is released, the pitches of the strings return to their original pitches.

U.S. Pat. No. 4,171,661, issued Oct. 23, 1979, to Rose, discloses a typical tremolo. The Rose tremolo includes a tremolo base, mounted on a fulcrum to pivot about an axis through the fulcrum and perpendicular to the strings. The guitar strings are attached to the tremolo base, so that pivoting the base changes the pitches of the strings.

A tremolo bar is attached to the tremolo base for pivoting the base. A tremolo block extends from the tremolo base into a cavity in the body of the guitar. A spring is connected between the tremolo block and the body of the guitar to return the tremolo base to its original position when the tremolo bar is released.

The tremolos of the prior art lack the ability to modulate the pitches of the strings individually. It is desirable to be able to selectively modulate the pitches of the strings either individually or collectively. Such an ability would add a large measure of versatility to the instrument.

SUMMARY OF THE INVENTION

The guitar of the invention includes the body, neck, nut, and strings of a typical guitar. The guitar also has a tremolo, mounted on the body and attached to the strings for selectively modulating the pitches of the strings either individually or collectively.

The tremolo of the invention has a fulcrum, such as an actuator rod, mounted on the guitar body. A tremolo base is attached to each string and is mounted on the actuator rod to pivot about an axis through the rod and perpendicular to the strings. A tremolo key is attached to each tremolo base for pivoting the tremolo base to modulate the pitch of the associated string.

A tremolo block extends from each tremolo base into a cavity in the body of the guitar. A spring, attached between the tremolo block and the guitar body, returns the tremolo base to a neutral position when the associated tremolo key is released.

The selection of individual or collective operation is made by pivoting a tremolo bar. A cam on the tremolo bar moves the actuator rod between a first position and a second position. In the first position, the actuator rod allows the tremolo keys to operate individually. In the second position, the actuator rod locks the tremolo keys together for collective operation.

DESCRIPTION OF THE PREFERRED EMBODIMENT

Figure 1:
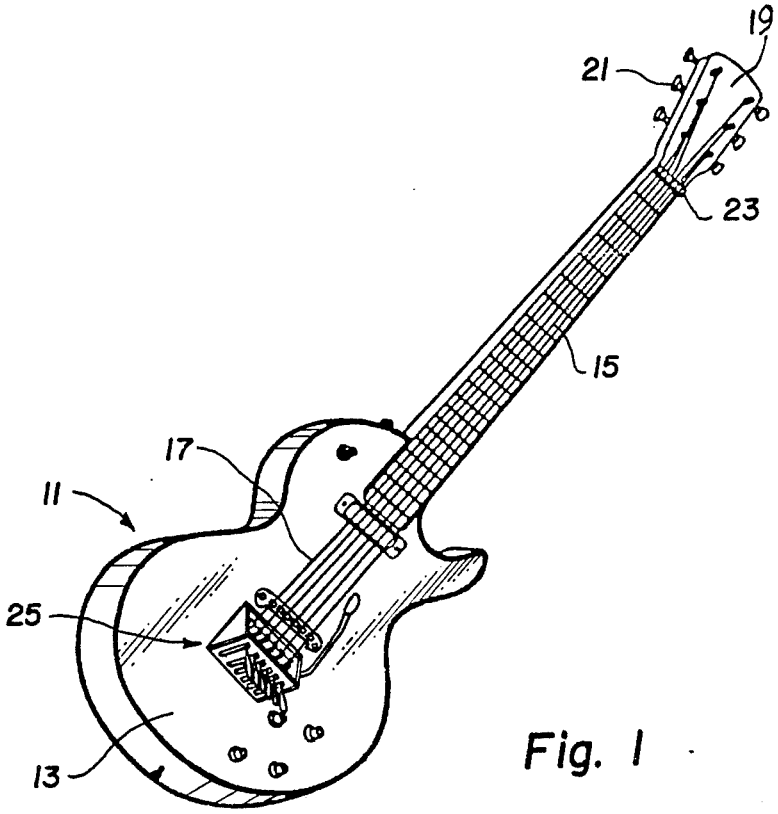
FIG. 1 is a perspective view of a guitar embodying the preferred embodiment of the invention.

As shown in FIG. 1, the guitar 11 of the invention has a body 13 and a neck 15 extending from the body 13, like any typical guitar. A plurality of strings 17, normally six, are attached to the distal end 19 of the neck 15. The ends of the strings 17 are wrapped around tuning pegs 21, so that the strings 17 can be tuned by changing the tension on the strings 17. The strings 17 are stretched over a nut 23 and down the neck 15 to the body of the guitar 11.

Figure 3:
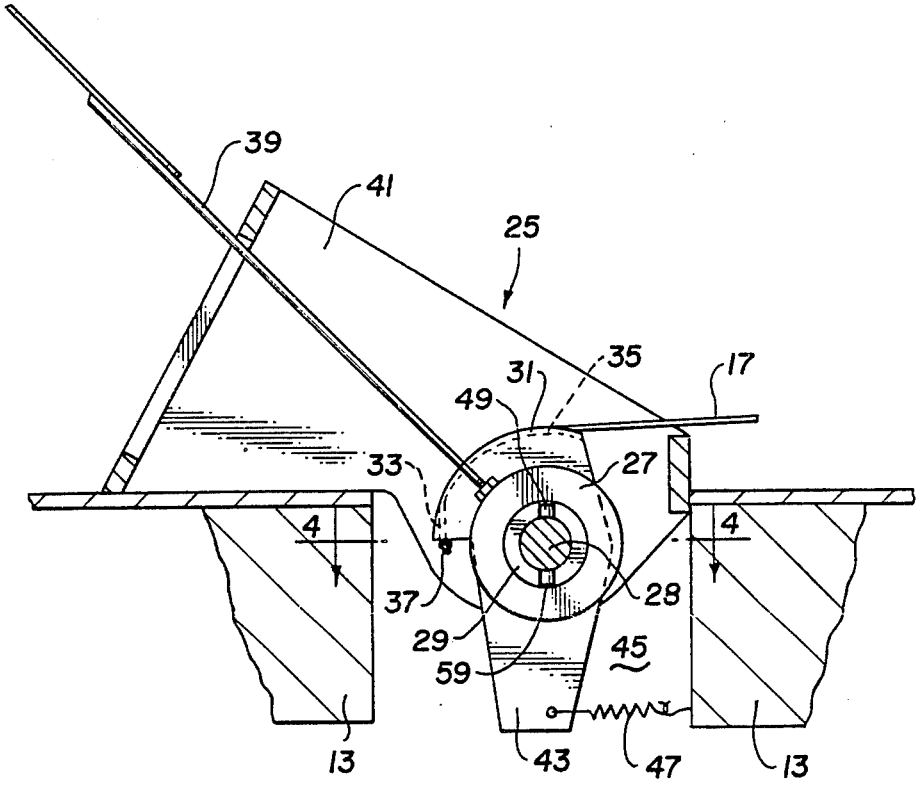
FIG. 3 is cross-sectional view of the tremolo as seen along lines 3—3 in FIG. 2.
Figure 4:
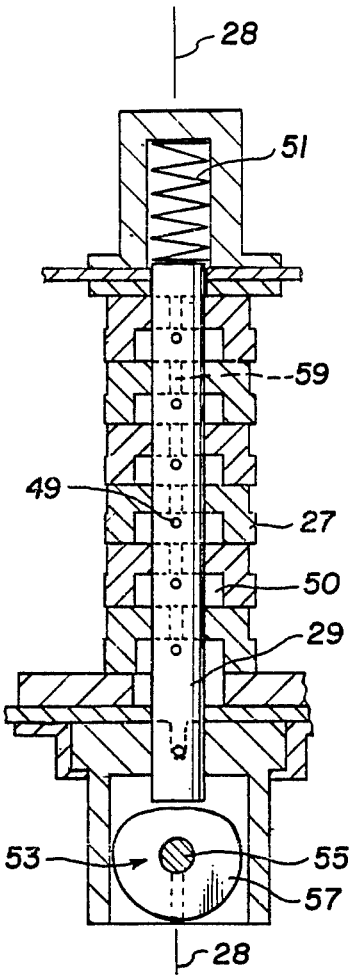
FIG. 4 is a cross-sectional view of an actuator rod and a tremolo bar as seen along lines 4—4 in FIG. 3, shown in the first position.
Figure 5:
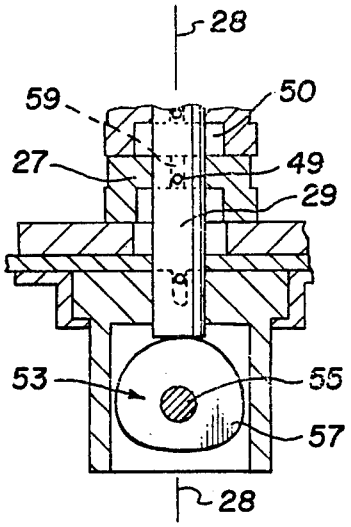
FIG. 5 is a cross-sectional view of an actuator rod and a tremolo bar as seen along lines 4—4 in FIG. 3, shown in the second position.

At the other end, the strings 17 are attached to a tremolo 25. The tremolo 25 is shown in greater detail in FIGS. 2–5. The tremolo 25 has six tremolo bases 27, one for each string 17 on the guitar 11. Each tremolo base 27 is mounted on an actuator rod 29, as shown in FIGS. 3–5. The tremolo bases 28 pivot about an axis 28 through the rod 29 and perpendicular to the strings 17.

Each string 17 is attached to an associated tremolo base 27. The string 17 passes over an eccentric surface 31 on the tremolo base 27 and through a hole 33 in the tremolo base 27. A groove 35 guides the string 17 over the eccentric surface 31. A stopper 37 on the end of each string 17 keeps the end of the string 17 from passing through the hole 33.

A tremolo key 39 is attached to each tremolo base 27. The tremolo key 39 is a lever arm for pivoting the associated tremolo base 27 about the actuator rod 29. The tremolo keys 39 extend thorugh a tremolo housing 41 to a point where the keys 39 can be easily reached.

As shown in FIG. 3, a tremolo block 43 extends from each tremolo base 27 into a cavity 45 in the body 13 of the guitar 11. A spring 47, attached between the tremolo block 43 and the body 13 of the guitar 11, biases the tremolo block 43 to counterbalance the tension in the string 17. When the tremolo key 39 is released, the spring 47 returns the tremolo block 43 and the tremolo base 27 to a neutral position.

As described earlier, the tremolo bases 27 are mounted on an actuator rod 29, as shown in FIGS. 3–5. The rod 29 has six projections 49, as shown in FIGS. 4 and 5, and is mounted for movement between a first position and a second position. The actuator rod 29 is biased toward the first position by a helical spring 51. In the first position, as shown in FIG. 4, the actuator rod 29 allows the tremolo keys 39 to operate independently, because the projections 49 are aligned within cavities 50 in the tremolo bases 27.

The actuator rod 29 can be moved to its second position by a tremolo bar 53. The tremolo bar 53 includes an activation lever 55 mounted for movement between a first position and a second position. When the tremolo bar 53 is in the first position, as shown in FIGS. 1 and 4, a cam 57 on the tremolo bar 53 allows the spring 51 to hold the rod 29 in the rod's 29 first position.

Figure 2:
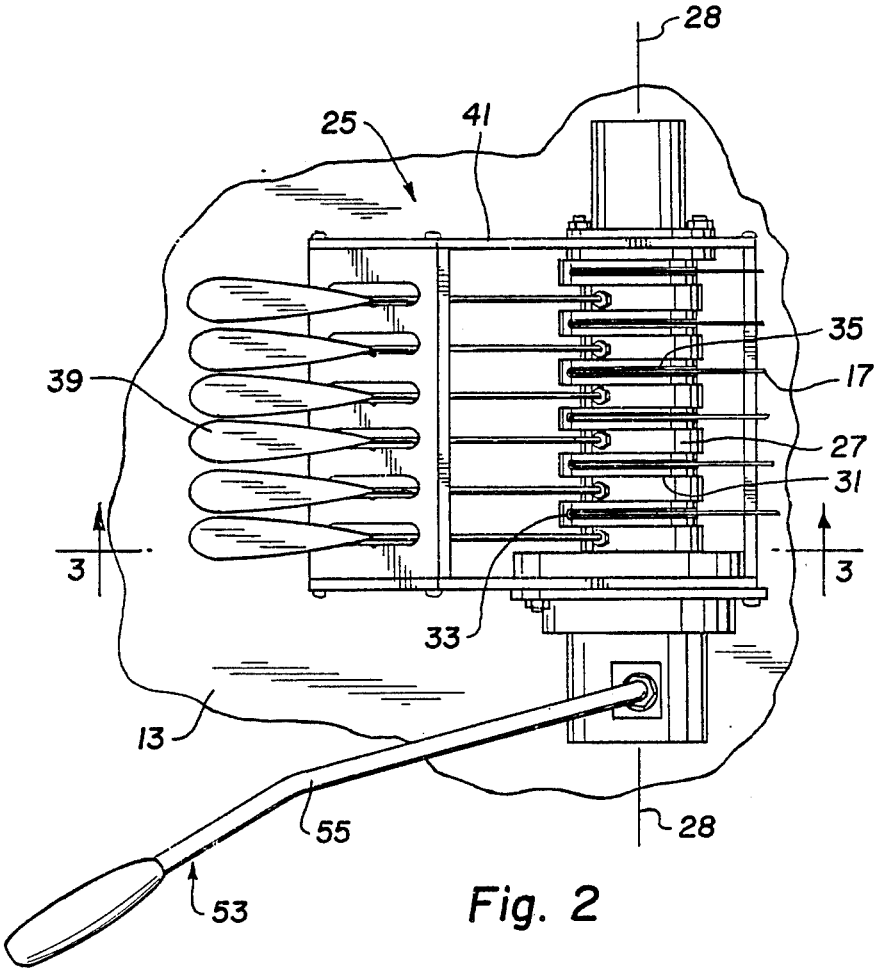
FIG. 2 is a plan view of a tremolo according to the invention.

When the activation lever 55 is pivoted to the second position, as shown in FIGS. 2 and 5, the cam 57 pushes the rod 29 into the rod's 29 second position. When the rod 29 is in its second position, the projections 49 are aligned within slots 59 in the tremolo bases 27. The projections 49 lock the tremolo bases 27 together, and the tremolo keys 39 can be pivoted collectively by pushing or pulling on the activation lever 55. The tremolo bar 53 and the actuator rod 29 thus form locking means for selectively locking the tremolo keys 39 together to selectively modulate the pitches of the strings 17 collectively. In some embodiments, the collective tremolo keys 39 may be pivoted by pushing or pulling on any one of the tremolo keys 39.

In operation, when the tremolo bar 53 and the actuator rod 29 are in the first position, as shown in FIGS. 1 and 4, the tremolo keys 39 can be used to modulate the pitches of the strings 17 individually. By pushing or pulling on a tremolo key 39, the pitch of the associated string 17 can be temporarily raised or lowered. When the tremolo key 39 is released, the spring 51 returns the tremolo key 39 to its neutral position and the string 17 to its original pitch.

When the tremolo bar 53 is moved from its first position to its second position, the cam 57 pushes the actuator rod 29 into the rod's second position. The projections 49 on the rod 29 enter the slots 59 in the tremolo bases 27 and lock the tremolo bases 27 together. Then, by pushing or pulling on the tremolo bar 53, the pitches of the strings 17 is modulated collectively.

The guitar 11 of the invention has several advantages over the prior art. By pushing on one tremolo key 39 and pulling on another, the pitch of one string 17 can be lowered and the pitch of another string 17 can be raised at the same time. Chords can be modulated without changing the left hand fingering. Also, the tremolo effect can be added to selected notes in a chord. Further, the tremolo 25 can be easily changed from individual to collective modulation.

The invention has been shown in only one of its forms. It should be apparent to those skilled in the art that it is not so limited, but is susceptible to various changes modifications without departing from the spirit of the invention.

I claim:

1. A guitar, comprising:

a body:

a neck, extending from the body;

a nut on the distal end of the neck;

a plurality of strings, attached to the distal end of the neck and stretched over the nut;

a plurality of tremolo bases, each tremolo base being attached to one of the strings and mounted on the body of the guitar to pivot about an axis perpendicular to the strings;

a plurality of tremolo keys, each tremolo key being attached to one of the tremolo bases for pivoting the tremolo base to modulate the pitch of the associated string;

a plurality of tremolo blocks, each tremolo block extending from one of the tremolo bases into a cavity in the body of the guitar;

a plurality of springs, each spring being attached between one of the tremolo blocks and the body of the guitar for returning the tremolo base to a neutral position when the associated tremolo key is released;

an actuator rod, mounted for movement between a first position, in which the actuator rod allows the tremolo keys to operate independently, and a second position, in which the actuator rod locks the tremolo bases together;

an activation lever mounted for movement between a first position and a second position; and a cam mounted on the activation lever in contact with the actuator rod to move the actuator rod between the first and second positions of the actuator rod as the activation lever is moved between the first and second positions of the activation lever.

2. A guitar as defined in claim 1, wherein the actuator rod has a plurality of projections, which are aligned within cavities in the tremolo bases to allow the tremolo bases to operate independently when the actuator rod is in the first position, and which are aligned within slots in the tremolo bases to lock the tremolo bases together when the actuator rod is in the second position.

3. A guitar as defined in claim 2, wherein the number of projections is equal to the number of tremolo bases.

4. A guitar as defined in claim 2, wherein the tremolo keys can be pivoted collectively by pushing and pulling on the activation lever when the activation lever is in the second position.

* * * * *